United States Patent [19]

Benoit et al.

[11] Patent Number: 4,907,354

[45] Date of Patent: Mar. 13, 1990

[54] ALPINE SKI BOOTS

[75] Inventors: Louis Benoit, Frangy; Bernard Nerrinck, La-Balme-de-Sillingy, both of France

[73] Assignee: Salomon S.A., Annecy Cedex, France

[21] Appl. No.: 178,579

[22] Filed: Apr. 7, 1988

[30] Foreign Application Priority Data

Apr. 17, 1987 [FR] France ..... 87 05949

[51] Int. Cl.[4] ..... A43B 5/04

[52] U.S. Cl. ..... 36/119; 36/93; 36/120

[58] Field of Search ..... 36/117–121, 36/88, 93

[56] References Cited

U.S. PATENT DOCUMENTS

| | | | |
|---|---|---|---|
| 3,945,135 | 3/1976 | Hanson et al. | 36/121 |
| 4,203,235 | 5/1980 | Van Pelt, Jr. | 36/121 X |
| 4,724,625 | 2/1988 | Sartor | 36/120 |

FOREIGN PATENT DOCUMENTS

| | | | |
|---|---|---|---|
| 0199995 | 10/1986 | European Pat. Off. . | |
| 253306 | 1/1988 | European Pat. Off. | 36/117 |
| 2049450 | 5/1971 | Fed. Rep. of Germany . | |
| 2107659 | 9/1972 | Fed. Rep. of Germany . | |
| 3527135 | 1/1987 | Fed. Rep. of Germany | 36/119 |
| 3721620 | 1/1988 | Fed. Rep. of Germany | 36/119 |
| 1391829 | 2/1965 | France . | |
| 2127470 | 10/1972 | France . | |
| 2334315 | 7/1977 | France . | |
| 2562395 | 10/1985 | France . | |

*Primary Examiner*—James Kee Chi

*Attorney, Agent, or Firm*—Sandler & Greenblum

[57] ABSTRACT

A ski boot comprising an upper. The upper has a rear portion comprising a foot maintenance apparatus. The foot maintenance apparatus comprises a support plate adjacent the internal wall of the rear portion of the upper. The support plate is at least partially affixed to the rear portion of the upper. The support plate has at least one deformation zone in a zone positioned above the heel of the foot being inserted in the boot.

38 Claims, 8 Drawing Sheets

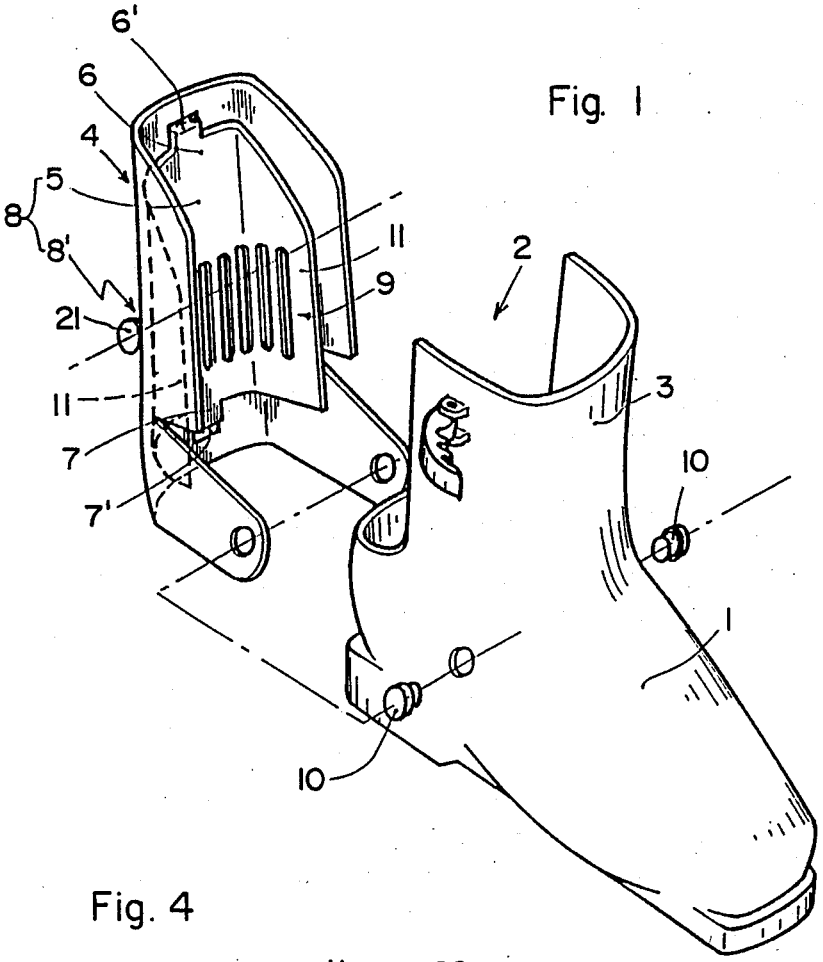
Fig. 1
Fig. 4
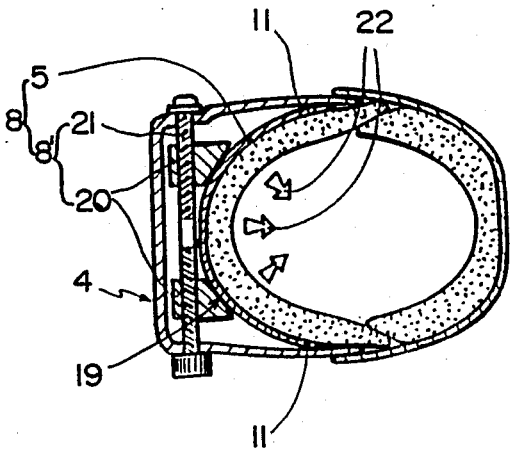

Fig. 2
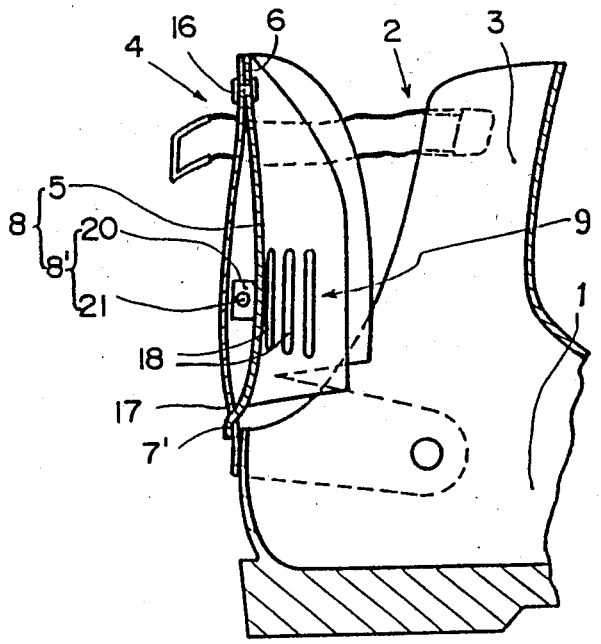
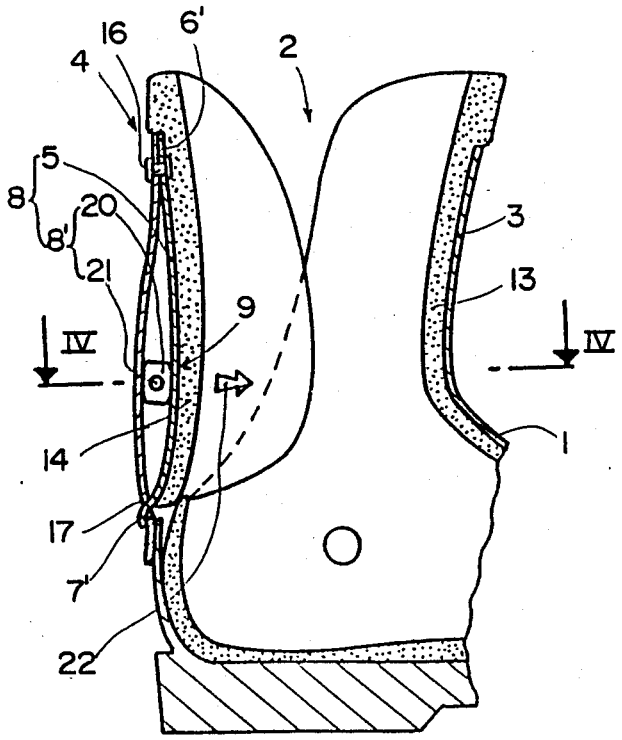
Fig. 3

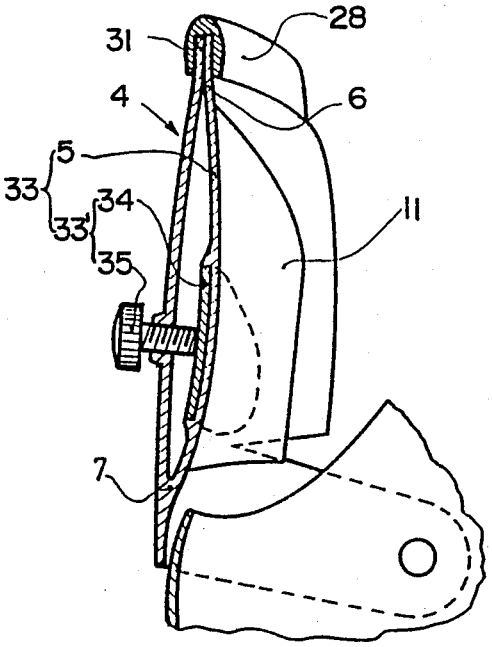
Fig. 7
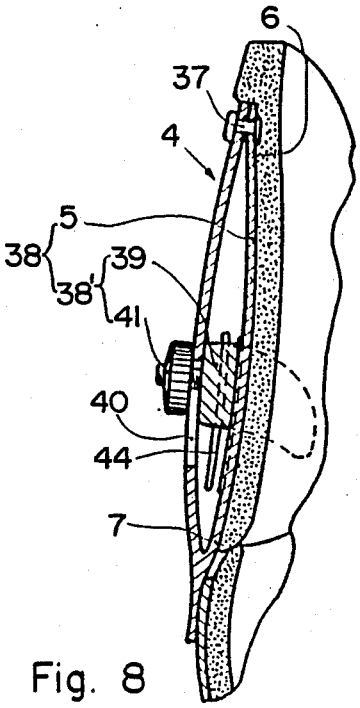
Fig. 8
Fig. 9
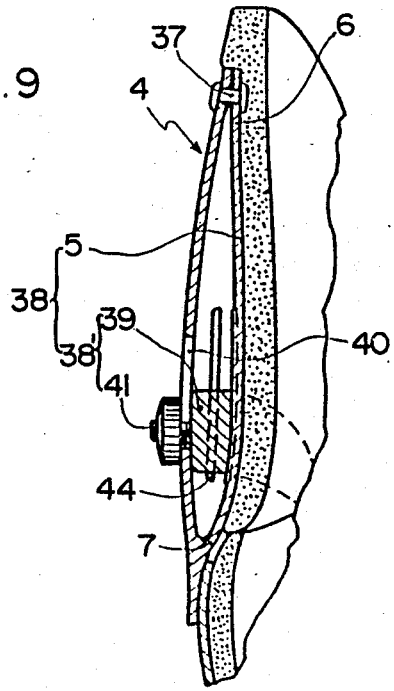
Fig. 10
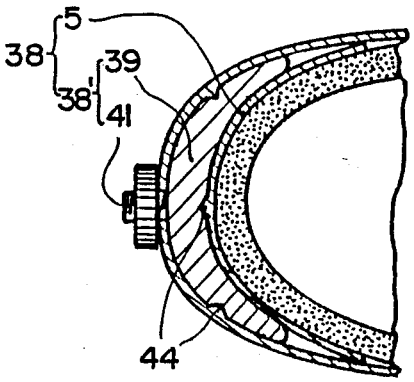

Fig. 11
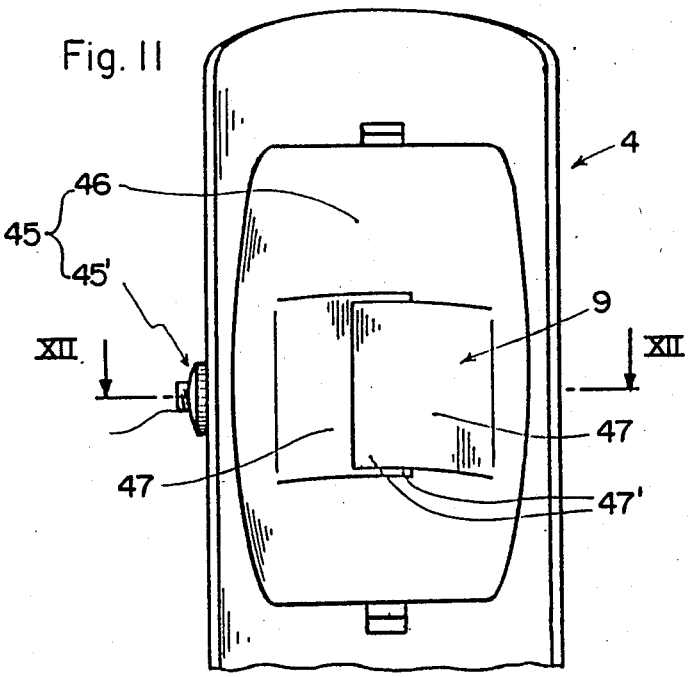
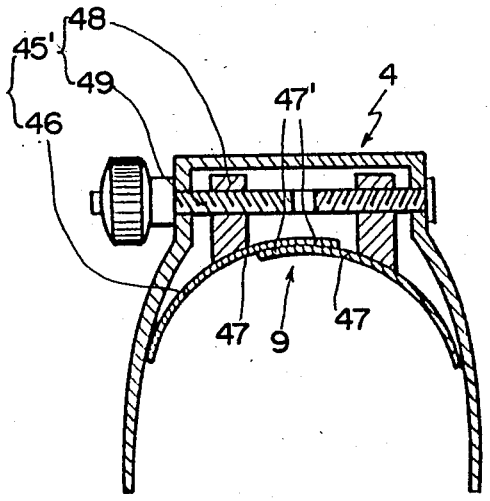
Fig. 12

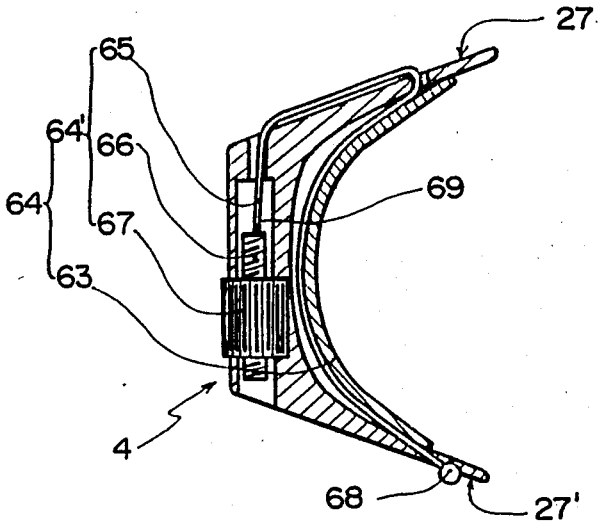
Fig. 15
Fig. 16
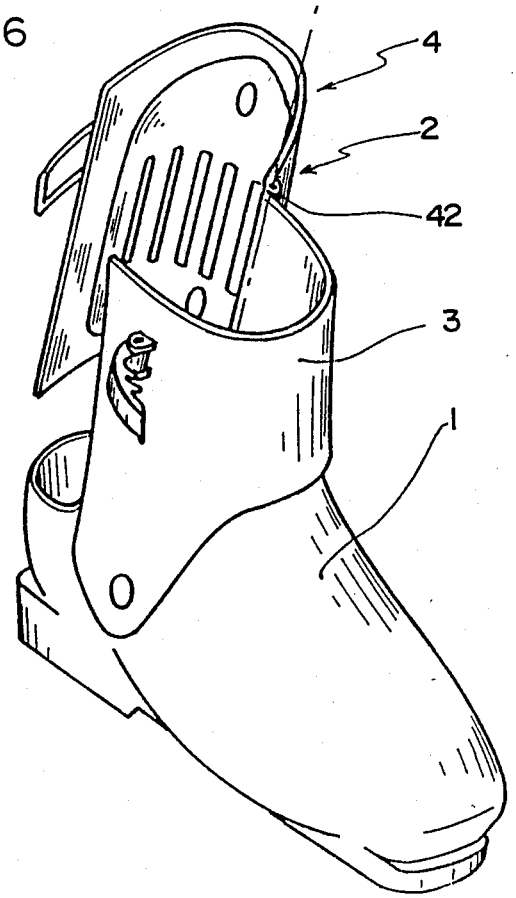

ALPINE SKI BOOTSBACKGROUND OF THE INVENTION

1. Field of the Invention

The present invention relates to alpine ski boots having a rigid shell base in which the rear rigid portion of the upper which surrounds the lower leg of the skier is provided with a foot grip.

2. Description of Background and Relevant Information

In a manner known in itself, alpine ski boots having foot grips comprise a comfort liner interposed between the rear rigid portion of the upper and the foot of the skier. This comfort liner generally contributes to the retention of the foot by assuring the wedging of the rear loWer portion of the loWer leg of the skier. Several designs for achieving this purpose are possible and consist principally either of utilizing the liner itself as a wedging means whose shape and/or volume are relatively adjustable to the corresponding portion of the foot (for example, by compressibility of the material, injection of polyurethane foam, thermal deformation of the material, utilization of an inflatable apparatus, etc.), or by modifying the relative position of the liner with respect to the foot, for example, in height and/or width, by means of an adjustment apparatus acting between the liner and rigid posterior portion of the upper of the boot. This latter solution is in particular taught by French Patents 1,391,829; 2,562,395; U.S. Pat. 3,945,135; and European Application 199,955. It will be noted that French Patent 1,391,829 describes an elastic wedging apparatus constituted by a plurality of springs which act between the rear rigid portion of the upper and the comfort liner by means of a rigid support plate. Such a wedging apparatus exerts a permanent pressure on the foot, which can be as much as a crushing effect, the greater the adjustment of the springs is to obtain a firm foot retention. Furthermore, in French Pat. 2,562,395; U.S. Pat. No. 3,945,135; and European 199,955, the wedging of the heel is achieved by means of mechanical adjustment apparatus which act on a support plate connected, or belonging to the rigid shell base, made of one piece, for example, with the shell base. This support plate is thus wedged between the adjustment apparatus and the wall of the liner or further, the support lining of the foot of the skier. In these types of construction the support plate is affixed to the lower portion of the rigid shell while the rear portion of the upper of the boot carries the adjustment apparatus. As a result, the adjustment of the wedging of the heel can only be felt in the closed position of the upper of the boot on the lower leg of the skier, the only position in which the adjustment apparatus are adapted to act on the support plate. As a result, such a constructional arrangement requires an active participation of the support liner during opening of the upper to space the support plate from the introduction passage of the foot in the boot.

SUMMARY OF THE INVENTION

A ski boot is provided which comprises an upper having a rear portion comprising a foot maintenance apparatus. The foot maintenance apparatus comprises a support plate adjacent the internal wall of the rear portion of the upper. The support plate is at least partially affixed to the rear portion of the upper and has at least one deformation zone in a zone positioned above the heel of the foot being inserted in the boot. The ski boot is most preferably an alpine ski boot having a cuff and a rear spoiler. In this case the rear portion is on the rear spoiler. The support plate is configured to cover at least a portion of the internal wall.

Adjustment means are mounted to extend within the rear portion and are manipulable from the exterior of the boot. The adjustment means comprises at least one pressure element positioned between the internal wall of the upper and the support plate, and faces the at least one deformation zone.

The support plate, in one embodiment, comprises side plates extending at least partially on both sides of the upper. The side plates in this embodiment are connected to the rear portion of the upper. The support plate may be affixed to the rear portion of the upper along at least one attachment point positioned on the longitudinal median axis of the rear portion.

In other embodiments the side plates are not connected to the internal wall of the rear portion of the upper.

In yet another embodiment, the support plate may be of a single piece with the rear portion of the upper along at least one end of the support plate.

The deformation zone of the support plate may be caused by a plurality of vertical slots, or a zone of reduced thickness of the support plate.

In one embodiment according to the invention the deformation zone comprises two distinct transverse flaps in a median zone of the wall of the support plate. The two transverse flaps may overlap on both sides of the longitudinal median axis of the support plate according to one sub-embodiment, or be cut away flaps having free ends extending towards the edges of side plates of the support plate.

The adjustment means may comprise at least one pressure element extending between the interior wall of the rear portion of the upper and the support plate, with the pressure element extending substantially until at least one of the side plates.

The adjustment means may also be in the form of at least one pressure element displaceable in a plane transverse to the longitudinal median axis of the rear portion of the upper, and in cooperative contact with the deformation zone. In this case the pressure element is a nut which moves along a screw to exert pressure at different locations on the deformation zone.

Alternatively, the at least one pressure element is displaceable in a substantially vertical plane containing the longitudinal median axis of the rear portion of the upper, and in cooperative contact with the deformation zone. The at least one pressure element is operated by a translationally displaceable element extending through an oblong vertical slot in the wall of the rear portion of the upper.

Rather than being relatively pivotable around a horizontal axis, the front and rear portions of the upper may be journalled for movement around a hinge establishing a vertical axis on the upper. Alternatively, the front and rear portions may be pivotable around separate horizontal axes.

BRIEF DESCRIPTION OF THE DRAWINGS

The invention will be better understood with reference to the annexed schematic reference drawings, given by way of non-limiting example only, in which several embodiments of the rear rigid portion of the upper of the boot are illustrated.

FIG. 1 illustrates, in exploded perspective view, an alpine ski boot having a rigid shell comprising a rear portion of the upper according to the invention; to facilitate the comprehension of the drawing, the liner and the comfort and/or wedging liner for the foot in the boot have not been shown in this figure;

FIGS. 2 and 3 illustrate respectively, in partial longitudinal cross-section, the ski boot of FIG. 1 without and with comfort liners;

FIG. 4 is a cross-sectional view along IV—IV of the boot of FIG. 3 illustrating the operation of an apparatus for maintaining the rear of the foot;

FIG. 7 illustrates in longitudinal cross-sectional view a rear rigid portion of the upper of a boot according to a first embodiment, which, in this example, comprises an apparatus for maintaining the foot by wedging it in the upper zone of the heel;

FIGS. 8, 9 and 10 illustrate, in longitudinal crosssectional view, a rear rigid portion of the upper of a boot according to a second embodiment in which is provided an apparatus for maintaining the foot by vertical translation of the wedging means at the upper zone of the heel;

FIGS. 11–14 illustrate two other ways of forming the deformation zone by a support plate at a rear portion of the upper according to the invention;

FIG. 15 is a transverse cross-sectional view of a rear portion of the upper of a boot illustrating an adjustment and maintenance apparatus of the foot provided with a pressure element constituted by a cable; and FIG. 16 illustrates a boot according to the invention whose rear portion of the upper is journalled on the front portion around a vertical rotation axis.

DESCRIPTION OF PREFERRED EMBODIMENTS

Figure 1A:
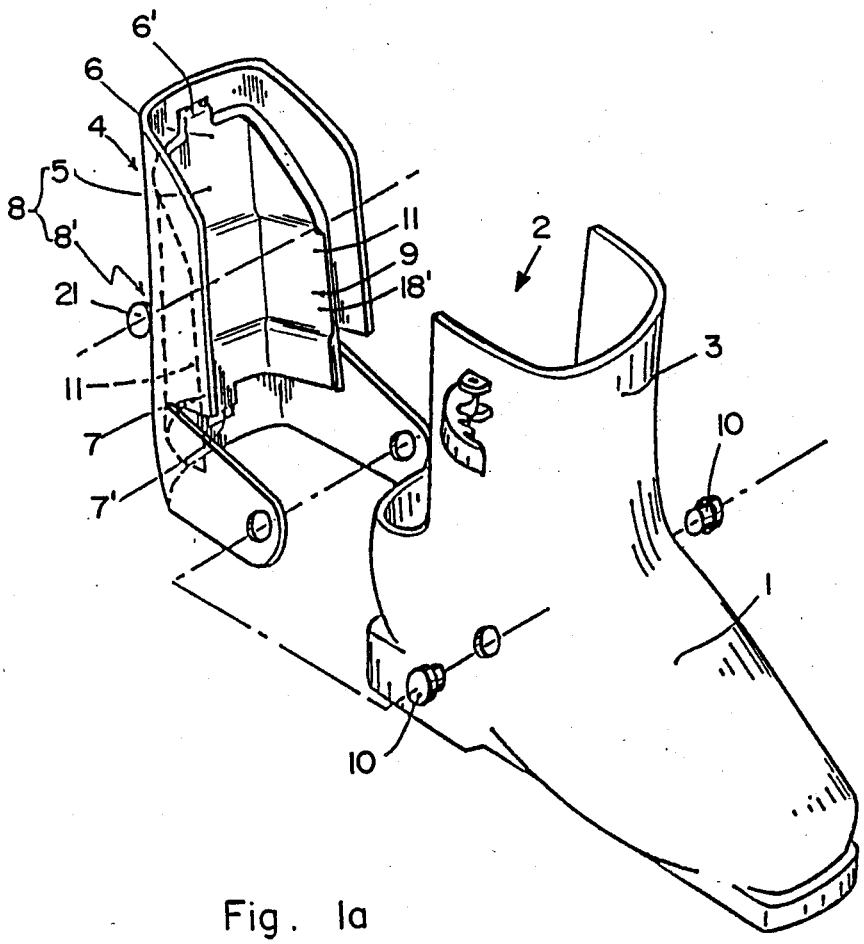
FIG. 1*a* is a view similar to FIG. 1 and illustrates an alternative deformation zone to that of FIG. 1.

It is an aim of the present invention to provide an improvement to ski boots, including those boots which function by rear-entry, comprising a foot maintenance apparatus. More particularly the invention relates to providing the rigid rear portion of the upper of the boot with at least one additional wall, having at least one localized deformation zone subjected to the action of an adjustment means adapted to adjust against the corresponding portion of the lower leg of the skier to assure its wedging. The affixation of the assembly of these wedging elements (deformable wall and adjustment apparatus) to the rear rigid portion of the upper of the boot furthermore makes it possible, and more particularly for the boots of the rear opening type, to vary widely and substantially clear the introduction passage and/or the removal passage of the foot, without requiring functional linkage with the lower portion of the shell of the boot.

According to the invention, the rear portion of the upper is provided with a flexible and deformable elongated plate which constitutes in fact a second wall, within the the upper, adapted to contact and shape the comfort and wedging liner.

To facilitate the understanding of the description which follows, the elongated deformable plate, which in certain cases is also flexible, will hereinafter be referred to as the "support plate" because it actually serves as a support for the comfort and wedging liner. This support plate extends substantially along the median longitudinal axis of the rear portion of the upper to which it is affixed by various means such as assembly elements, molding out of a single piece with the rear spoiler, etc. Preferably, this support plate can at least partially surround the rear lower portion of the lower leg by lateral side plates which may or may not be connected to the wall of the rear portion of the upper. The plate comprises a deformation zone provided between its upper and lower ends which is constituted, for example, by a thinning of its wall, by a plurality of slots oriented either along its longitudinal axis or along its transverse axis, or further by elastically deformable portions. The material out of which the plate is made may be plastic or any other appropriate material. Apparatus means for adjusting the deformation adapted to act at the level of the deformation zone of the plate is interposed between the wall of the rear rigid portion of the upper to which it is connected and the support plate.

Depending upon the extent of wedging desired, one can provide various adjustment apparatus adapted to deform the support plate against the rear lower portion of the leg of the skier in a zone positioned above the heel and/or on both sides of this zone in the direction of the hollow of the malleolus. Thus, by way of example, in the case of the wedging of the upper zone of the heel, one can utilize a screw apparatus whose effect will be at right angles to the wall of the rear portion of the upper.

In the case of a more enveloping wedging, it will be preferable to rely upon an apparatus comprising a support element comprising two lateral semi-rigid wings which will be affixed to a tightening element. This latter element will thus comprise means for displacing the two wings with respect to one another and acting on the foot in a manner of a tightening screw. It is obvious that such an apparatus will be positioned transversely to the longitudinal axis of the support plate to cause the deformation of the lateral side plates of the support plate. It is of course understood that numerous other adjustment apparatus associated with the deformable support plate can constitute different models of the maintenance apparatus of the foot contained within the scope of the present invention.

Furthermore, the comfort and/or wedging liner of the foot of the skier in the rigid shell can likewise be associated with the rear rigid portion of the upper in the zone corresponding to the maintenance apparatus of the foot, even of the lower leg.

The ski boot shown schematically in FIG. 1 comprises a rigid shell 1 which receives the foot of the skier and an upper 2 which surrounds the lower leg of the skier. Upper 2 is constituted by a front portion or cuff 3 which is fixed in position at a rear portion or rear spoiler 4 journalled on axis 10 with respect to front portion 3 to allow for the introduction and/or the removal of the foot of the skier from the boot. According to the invention, rear portion 4 is provided with a foot maintenance apparatus 8 comprising a support plate 5 which extends along its longitudinal axis and whose two lateral portions 11 partially surround the corresponding portion, not shown, of the lower leg of the skier. Plate 5 is affixed to the rear portion 4 by its upper end 6 and lower end 7 by means of affixation flaps 6′ and 7′. An adjustment apparatus 8′ is likewise mounted on the rear portion of the upper and is adapted to modify the longitudinal and/or transverse shape of a deformable zone 9 provided between ends 6 and 7 of the support plate.

FIGS. 2 and 3 more precisely illustrate the affixation means of support plate 5 with the rear portion 4 of upper 2 of the boot. FIG. 3 illustrates the adaptation of a comfort liner 14 to this rear portion 4 independently of internal bootie 13 positioned in rigid shell 1. As has been previously explained, support plate 5 is affixed to the rear portion 4 by means of attachment flaps 6' and 7', which, in this example, are respectively retained by riveting 16 and by hooking in a cut-out 17. To favor the deformation of the support plate 5 in its deformable zone 9, the support plate is preferably formed with a plurality of slots 18 which are oriented along its longitudinal axis and situated facing the adjustment apparatus 8' which results in a lateral wedging (FIG. 4) by virtue of lateral side plates 11 of plate 5 which are free to move with respect to the rear portion 4 of the upper. The deformation zone, alternatively, could be created by means of an area of reduced thickness 18', having dimensions appropriately determined. This adjustment apparatus comprises pressure elements such as two lateral nuts 20 affixed to a tightening element such as a screw 21 provided with two threaded shafts having opposing taps. Each nut 20 is mounted on one of the threaded shafts of screw 21 and is immobilized rotationally by the wall of the rear portion 4 of the upper and/or by support 5. Support 5 has in transverse cross-sectional view at its longitudinal axis a curvilinear shape which partially surrounds the rear portion of the lower leg by means of its lateral side plates 11. Furthermore, each of screws 20 is provided with an inclined ramp 19 which is oriented in a manner so as to press itself tangentially against the curvilinearly shaped element. Thus, on the side of the respective position of nuts 20 on screw 21 and consequently of the ramp 19, on both sides of the curvilinear shape of support plate 5, adjustment apparatus 8' acts as a tightening screw on the support plate. In effect, rotational manipulation of screw 21, for example, in the direction of a coming together of nuts 20, causes support plate 5 to be pushed in the direction of the lower rear portion of the leg of the skier as indicated by arrows 22 (FIGS. 3 and 4).

Figure 5:
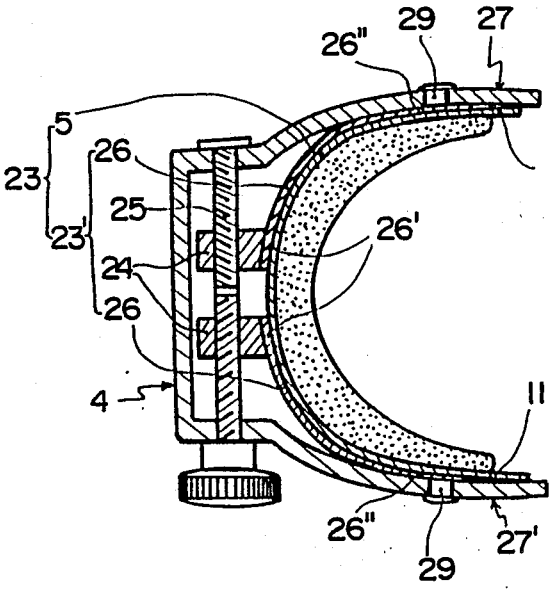
FIGS. 5 and 6 illustrate, in cross-section along IV—IV of FIG. 3, another embodiment of a foot maintenance apparatus in a rear rigid portion of the upper of a boot according to the invention.
Figure 6:
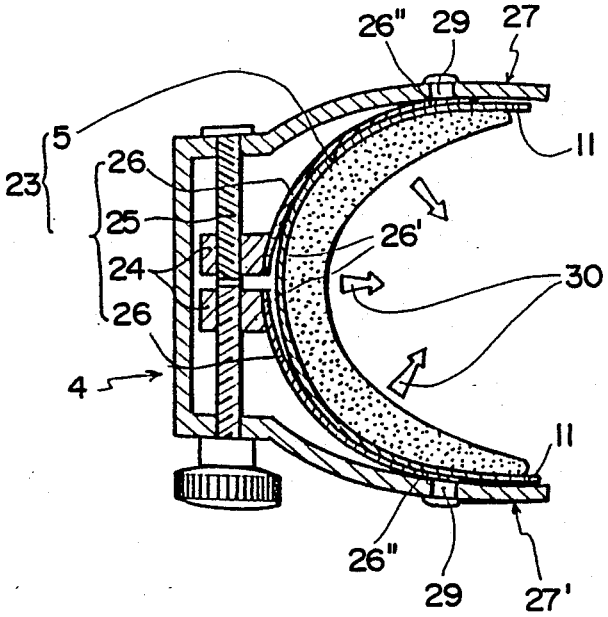

Foot maintenance apparatus 23 shown in FIGS. 5 and 6 is configured substantially in the same manner as the one previously described and comprises an adjustment apparatus 23' comprising also a screw 25 having two oppositely threaded shafts on which are mounted nuts 24. On the other hand, in this embodiment, nuts 24 cause the deformation and/or displacement of support plate 5 by means of pressure elements such as flexible straps 26. These straps 26 are each connected at their ends 26' and 26'' on the one hand to a nut 24 and on the other hand to the wall of the side 27 and 27' of the rear portion 4 of the upper, generally at the level of lateral side plates 11 of support plate 5. Ends 26' of straps 26 can, for example, be connected to nuts 24 by gluing or welding and straps 26'' can be connected by stapling or riveting 29 to the wall of sides 27 and 27'. As seen in the example of FIG. 5, straps 26 mate with the curvilinear shape of support plate 5 such that nuts 24 are spaced from one another by an amount so as not to cause the tensioning of the straps. From this position if nuts 24 are brought together by the manipulation of screw 25 straps 26 serve to push support plate 5 in converging direction 30 towards the rear portion of the leg of the skier.

One can of course adapt other foot maintenance apparatus adapted to the rear portion of the upper of the boot and achieve the effect of support plate 5 according to other embodiments without going beyond the scope of the invention.

Thus, FIG. 7 illustrates a rear portion 4 of the upper of a boot having support plate 5 formed of one piece with the wall of portion 4 at its lower end 7. A nesting element 28 assures the attachment of the upper end 6 of the support plate 5 with the upper edge 31 of the rear portion 4 of the upper. The foot maintenance apparatus 33 comprises a wedging adjustment apparatus 33' comprising, in this example, a pressure element constituted by a shaping wedge 34 which partially surrounds the corresponding deformable portion of support plate 5 in the direction of the lateral side plates 11 of plate 5, and a tightening element 35 such as as threaded button or knob adapted to cooperate with wedge 34. By screwing threaded button 35 to a greater or lesser extent one causes the simultaneous displacement of shaping wedge 34 and support plate 5 relative to the rigid wall of rear portion 4.

Again, in FIGS. 8, 9 and 0, support plate 5 can be formed as explained previously with reference to FIG. 7 and be connected at its upper end 6 to the wall of the rear portion 4 of the upper by means of riveting 37.

Furthermore, foot maintenance apparatus 38 can simply comprise a pressure element such as a detachable wedge 39 interposed between the wall of the rear portion 4 and support plate 5. Furthermore, adjustment apparatus 38' acting on support plate 5 is constituted by an oblong opening 40 provided in the rear portion 4 of the upper and a control means 41 of wedge 39 which passes through the opening. Preferably, rear portion 4, support plate 5, and wedge 39 are provided with guidance means 44 oriented in the direction of the displacement of wedge 39 between its various possible adjustment positions. By displacing wedge 39 in the vertical direction it is possible to effect a more or less pronounced deformation of support plate 5 towards the upper end 6 of the support plate, or towards its lower end 7.

In FIGS. 11 and 12 maintenance apparatus 45 comprises a support plate 46 affixed to the rear portion 4 of the upper by means of two attachment flaps 47 through which support plate 46 is connected to an adjustment apparatus 45' of the type 8' previously described with reference to FIG. 4. In this embodiment of the invention, the deformation zone of the support plate is constituted by two flexible tongues or flaps 47 which on the one hand extend transversely to the longitudinal median axis on the rear portion 4 and on the other hand, overlap partially through their free ends 47'. The pressure elements or nuts 48 of adjustment apparatus 45' are positioned to correspond with the flexible flaps 47 such that their translational displacement on screw 49, during rotational manipulation of the latter, causes a greater or lesser deformation of tongues 47 as they are brought towards and away from one another.

Figure 13:
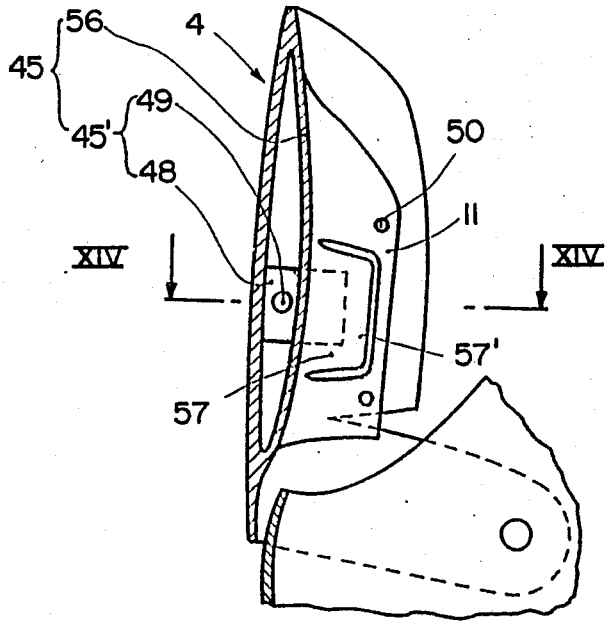
Figure 14:
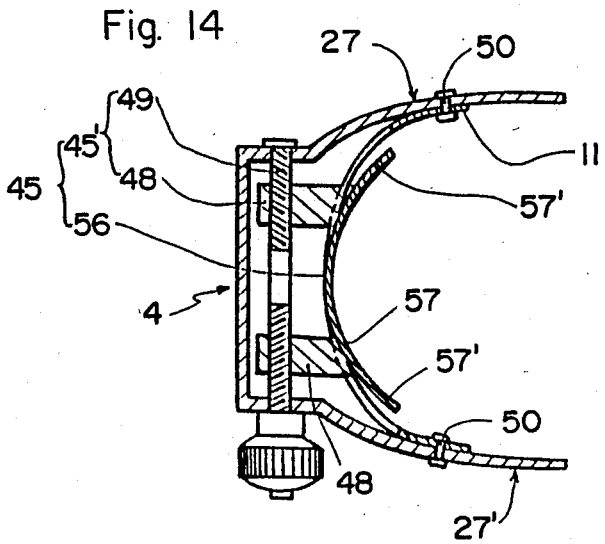

Furthermore, as may be seen in FIGS. 13 and 14, support plate 56 can also be formed with two flexible tongues or flaps 57 which extend transverse to the longitudinal median axis of the rear portion 4, and whose free ends 57' extend towards the edges of the lateral side plates of support plate 56. Adjustment apparatus 45' can be of the type which was described in FIG. 12 with pressure being exerted on the flexible tongues. Furthermore, in the instant embodiment, lateral side plates 11 of support plate 56 are preferably affixed to sides 27 and 27' of rear portion 4 by means of rivets 50, for example.

According to the embodiment of FIG. 15, maintenance apparatus 64 comprises an adjustment apparatus 64' constituted by a pressure element such as a cable 65 affixed in tension to a screw 66-nut 67 system. The pressure element or cable 65 is anchored in one of the sides 27' of the upper by one of its ends 68 and extends between the interior wall of portion 4 and support plate 63 which it surrounds until a second side 27 of portion 4 from where it is then returned, through its second end 69, until a screw 66-nut 67 system. It is obvious that this second end 69 of cable 65 is set in and/or affixed by any other known means to screw 66.

It is self evident that the maintenance apparatus of the foot according to the invention is likewise adaptable to boots whose rear portion 4 of upper 2 is journalled with respect to the front portion 3 along different pivot axes than those shown in FIG. 1. In the case of FIG. 16, for example, the pivoting axis is particularly oriented such that the portion 4 pivots in a horizontal plane around vertical axis. In this example, the pivoting is achieved by a hinged journal 42 affixed to the upper 2 of the boot. Likewise, the rear portion 4 can also be totally detachable from the front portion 3 and/or the rigid shell 1, or be pivotable around an offset horizontal axis.

Finally, although the invention has been described with reference to particular means, materials and embodiments, it is to be understood that the invention is not limited to the particulars disclosed and extends to all equivalents within the scope of the claims.

We claim:

1. A ski boot comprising an upper, said upper having a rear portion comprising a foot maintenance apparatus, said foot maintenance apparatus comprising a support plate adjacent the internal wall of the rear portion of the upper, said support plate being at least partially affixed to said rear portion of said upper, said support plate having at least one deformation zone in a zone positioned above the heel of the foot being inserted in said boot.

2. The ski boot as defined by claim 1 wherein said ski boot is an alpine ski boot, and said upper is formed of a cuff and a rear spoiler, and wherein said rear portion is on said rear spoiler.

3. The ski boot as defined by claim 1 wherein said support plate covers at least a portion of said internal wall.

4. The ski boot as defined by claim 1 further comprising adjustment means mounted to extend within said rear portion, said adjustment means being manipulatable from the exterior of said boot, said adjustment means comprising at least one pressure element positioned between the internal wall of the upper and said support plate, and facing said at least one deformation zone.

5. The ski boot as defined by claim 4 wherein said support plate comprises side plates extending at least partially on both sides of the upper.

6. The ski boot as defined by claim 5 wherein said side plates are connected to the rear portion of the upper.

7. The ski boot as defined by claim 5 wherein said side plates are not connected to the internal wall of said rear portion of said upper.

8. The ski boot as defined by claim 1 wherein said support plate is affixed to the rear portion of said upper along at least one attachment point positioned on the longitudinal median axis of said rear portion.

9. The ski boot as defined by claim 1 wherein said support plate is of a single piece with the rear portion of said upper along at least one end of said support plate.

10. The ski boot as defined by claim 1 wherein said deformation zone of said support plate comprises a plurality of vertical slots.

11. The ski boot as defined by claim 1 wherein said deformation zone is a zone of reduced thickness of said support plate.

12. The ski boot as defined by claim 1 wherein said deformation zone comprises two distinct transverse flaps in a median zone of the wall of said support plate.

13. The ski boot as defined by claim 12 wherein said two transverse flaps overlap on both sides of the longitudinal median axis of said support plate.

14. The ski boot as defined by claim 1 wherein said deformation zone comprises cut away flaps having free ends extending towards the edges of side plates of said support plate.

15. The ski boot as defined by claim 1 wherein said support plate comprises two side plates on opposite sides of said support plate, and said adjustment means comprises at least one pressure element extending between the interior wall of the rear portion of the upper and the support plate, said pressure element extending substantially until at least one of said side plates.

16. The ski boot as defined by claim 1 wherein said adjustment means comprises at least one pressure element displaceable in a plane transverse to the longitudinal median axis of the rear portion of the upper, and in cooperative contact with said deformation zone.

17. The ski boot as defined by claim 16 wherein said pressure element is a nut which moves along a screw to exert pressure at different locations on said deformation zone.

18. The ski boot as defined by claim 1 wherein said adjustment means comprises at least one pressure element displaceable in a substantially vertical plane containing the longitudinal median axis of the rear portion of the upper, and in cooperative contact with the deformation zone.

19. The ski boot as defined by claim 18 wherein said at least one pressure element is operated by a translationally displaceable element extending through an oblong vertical slot in the wall of the rear portion of the upper.

20. The ski boot as defined by claim 1 wherein said upper comprises a cuff and rear spoiler pivotally mounted on a horizontal axis of a shell base.

21. The ski boot as defined by claim 1 wherein said upper comprises a cuff and rear spoiler, said cuff and rear spoiler being journalled for movement around a hinge establishing a vertical axis on said upper.

22. The ski boot as defined by claim 1 wherein said support plate is affixed to the rear portion of said upper in the upper portion of said support plate.

23. The ski boot as defined by claim 22 further comprising adjustment means for adjusting the amount of pressure exerted on said deformation zone to vary the extent that the foot is held within said boot.

24. The ski boot as defined by claim 23 wherein said adjustment means comprises at least one nut translationally slidably mounted on an adjustment screw arranged transversely to the longitudinal median axis of said boot, said at least one nut being positioned to exert varying amounts of pressure as a function of its transverse position on said screw for exerting different amounts of pressure on said support plate.

25. The ski boot as defined by claim 22 wherein said deformation zone comprises a plurality of longitudinally extending slots for weakening the deformation zone to render it more elastic.

26. The ski boot as defined by claim 25 further comprising a strap extending between each of said nuts and one side of said internal wall of the rear portion of the upper, each of said straps exerting varying amounts of pressure on said deformation zone in response to adjustment of each of said at least one nut.

27. The ski boot as defined by claim 1 further comprising adjustment means for adjusting the amount of pressure exerted on the rear portion of a foot inserted in said boot by said support plate, said adjustment means comprising an adjustment screw extending into the rear portion of said upper, and being adjustable from the outside of said boot, said adjustment screw exerting pressure directly on a shaping wedge affixed to the rear portion of said support plate.

28. The ski boot as defined by claim 27 wherein said support plate is molded of a single piece with the rear portion of said upper.

29. The ski boot as defined by claim 1 comprising adjustment means for adjusting the amount of pressure exerted on said support plate, said adjustment means comprising a shaping wedge positioned between said support plate and the rear portion of said upper, said adjustment means being guided for vertical translational movement in the space between said support plate and said rear support portion.

30. The ski boot as defined by claim 29 further comprising an adjustment screw for adjusting the vertical position of said shaping wedge.

31. The ski boot as defined by claim 1 further comprising adjustment means for adjusting the amount of pressure exerted on said foot by said support plate, said support plate comprising two overlapping portions each affixed to a nut translationally movable along a transverse adjustment screw at the rear portion of said upper, each of said nuts being adapted to move one of said portions transverse to the longitudinal median axis of said boot.

32. The ski boot as defined by claim 1 wherein said plate comprises two cut-away flaps forming said deformation zone, said boot further comprising a pressurization means for exerting pressure on each of said flaps, said pressurization means comprising a nut connected to each of said flaps, each of said nuts being adapted for transverse movement to the longitudinal axis of said boot on a transverse adjustment screw.

33. The ski boot as defined by claim 1 further comprising pressurization means for exerting pressure on said deformation zone, said pressurization means comprising a cable secured at one side of the rear portion of said upper and extending behind said deformation zone to the opposite side of the rear portion of said upper, and adjustment means for adjusting the pressure exerted by said cable on said deformation zone.

34. The ski boot as defined by claim 33 wherein said adjustment means comprises an adjustment screw for varying the tension on said cable.

35. The ski boot as defined by claim 34, wherein said adjustment screw is in-set in the rear portion of said upper.

36. The ski boot as defined by claim 1 further comprising a boot liner.

37. A ski boot comprising an upper, said upper having a rear portion including a foot maintenance apparatus comprising a support plate adjacent the internal wall of the rear portion of the upper, said support plate being at least partially affixed to said rear portion of said upper, said support plate having at least one deformation zone in a zone positioned on a portion of the lower leg above the heel of the foot being inserted in said boot, whereby said deformation zone of said support plate is deformable against the portion of the lower leg to securely hold the foot in the boot.

38. The ski boot as defined by claim 37, further comprising adjustment means comprising at least one pressure element positioned between the internal wall of the upper and said support plate and facing said at least one deformation zone, said pressure element being adapted to press against said at least one deformation zone to deform said support plate at said at least one deformation zone.

* * * * *